US010396433B2

(12) United States Patent
Wu et al.

(10) Patent No.: US 10,396,433 B2
(45) Date of Patent: Aug. 27, 2019

(54) MOBILE TERMINAL

(71) Applicants: Xiaopu Wu, Shenzhen (CN); Yongli Chen, Shenzhen (CN)

(72) Inventors: Xiaopu Wu, Shenzhen (CN); Yongli Chen, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/354,549

(22) Filed: Nov. 17, 2016

(65) Prior Publication Data

US 2017/0358844 A1 Dec. 14, 2017

(30) Foreign Application Priority Data

Jun. 10, 2016 (CN) ..... 2016 1 0402857

(51) Int. Cl.

| | |
|---|---|
| ***H01Q 1/24*** | (2006.01) |
| ***H01Q 1/22*** | (2006.01) |
| ***H01Q 1/50*** | (2006.01) |
| ***H01Q 1/42*** | (2006.01) |
| ***H01Q 5/335*** | (2015.01) |
| ***H01Q 5/35*** | (2015.01) |

(52) U.S. Cl.

CPC ..... *H01Q 1/243* (2013.01); *H01Q 1/2291* (2013.01); *H01Q 1/42* (2013.01); *H01Q 1/50* (2013.01); *H01Q 5/335* (2015.01); *H01Q 5/35* (2015.01)

(58) Field of Classification Search

CPC ..... H01Q 1/243; H01Q 1/50; H01Q 1/2291; H01Q 5/35; H01Q 5/335; H01Q 1/42

See application file for complete search history.

(56) References Cited

U.S. PATENT DOCUMENTS

| | | | | |
|---|---|---|---|---|
| 9,041,606 | B2 * | 5/2015 | Faraone | H01Q 13/10 343/702 |
| 9,203,140 | B2 * | 12/2015 | Yong | H01Q 1/243 |
| 9,337,539 | B1 * | 5/2016 | Ananthanarayanan | H01Q 5/335 |
| 9,711,841 | B2 * | 7/2017 | Yong | H01Q 1/243 |
| 2007/0146212 | A1 * | 6/2007 | Ozden | H01Q 1/243 343/702 |
| 2014/0313087 | A1 * | 10/2014 | Jiang | H01Q 3/22 343/745 |
| 2016/0329627 | A1 * | 11/2016 | Hong | H01Q 1/243 |

* cited by examiner

*Primary Examiner* — Hai V Tran
*Assistant Examiner* — Michael M Bouizza
(74) *Attorney, Agent, or Firm* — Na Xu; IPro, PLLC

(57) ABSTRACT

A mobile terminal is disclosed. The mobile terminal includes a housing having an accommodation space, the housing including a metal frame; a mainboard received in the accommodation space and including a ground point provided on a surface thereof; an antenna system grounded through the mainboard. The antenna system includes a main antenna including a low-frequency feeding portion and a high-frequency feeding portion both of which are respectively connected to the metal frame; and a matching system configured on the metal frame for adjusting the frequency band of the antenna system. The high-frequency feeding portion is isolated from the low-frequency feeding portion through a LC filtering system.

10 Claims, 3 Drawing Sheets

MOBILE TERMINAL

FIELD OF THE INVENTION

The present invention relates to the technical field of communication, and more specifically, to a mobile terminable.

DESCRIPTION OF RELATED ART

With the continuous development of mobile terminal equipment such as mobile phones and tablet computers, there are higher and higher requirements for terminal signals, speech quality and appearance. Mobile terminals with an all-metal back cover enjoy the tremendous popularity among consumers by virtue of the metallic texture, ruggedness and wear-resistance.

However, the all-metal back cover shields the signals of the antenna module in the mobile terminal equipment. In some mobile terminal equipment of related technologies, a slot is made in a part of metal back cover which is opposite to the antenna module to prevent the metal back cover from interfering antenna signals, which sacrifices the consistency of the housing appearance and affects the overall appearance of the mobile terminal equipment.

Therefore, it is necessary to provide an improved mobile terminal to overcome above disadvantage.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiments described hereby is only to explain this disclosure, not intended to limit this disclosure.

Figure 1:
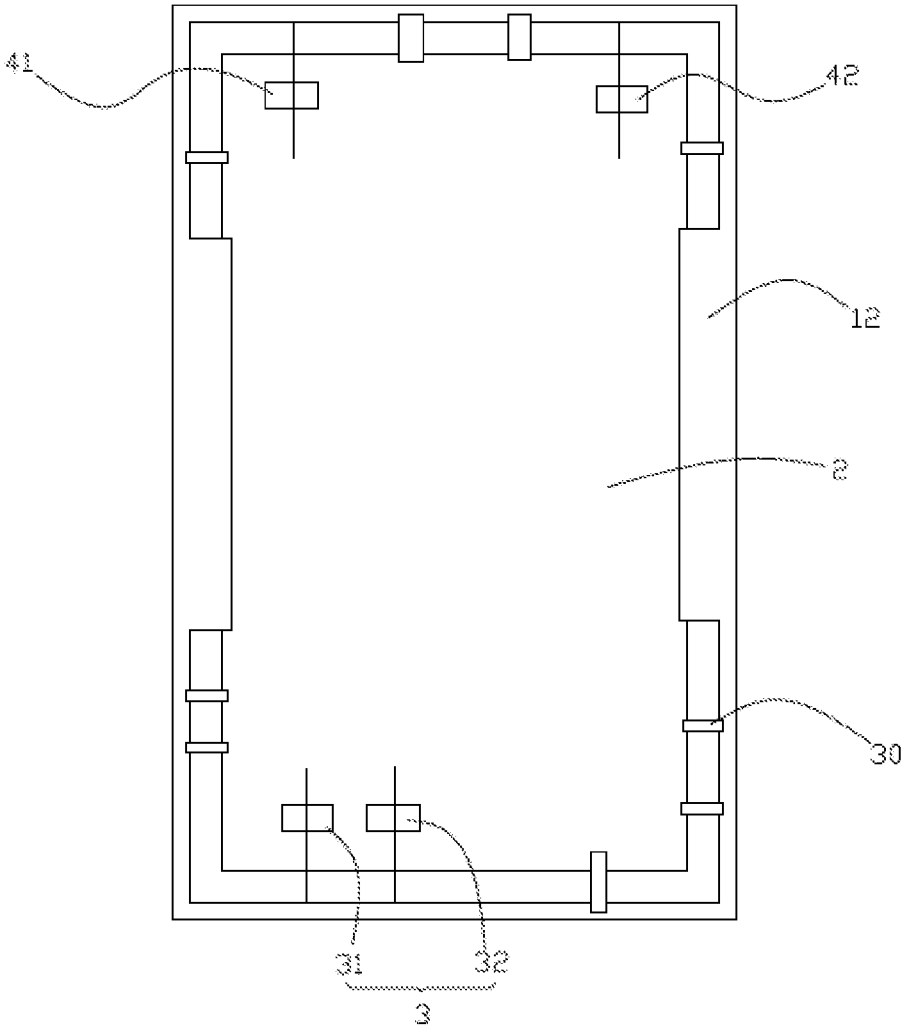
FIG. 1 is an illustrative schematic diagram of an antenna system of a mobile terminal in accordance with an exemplary embodiment of the present disclosure.
Figure 2:
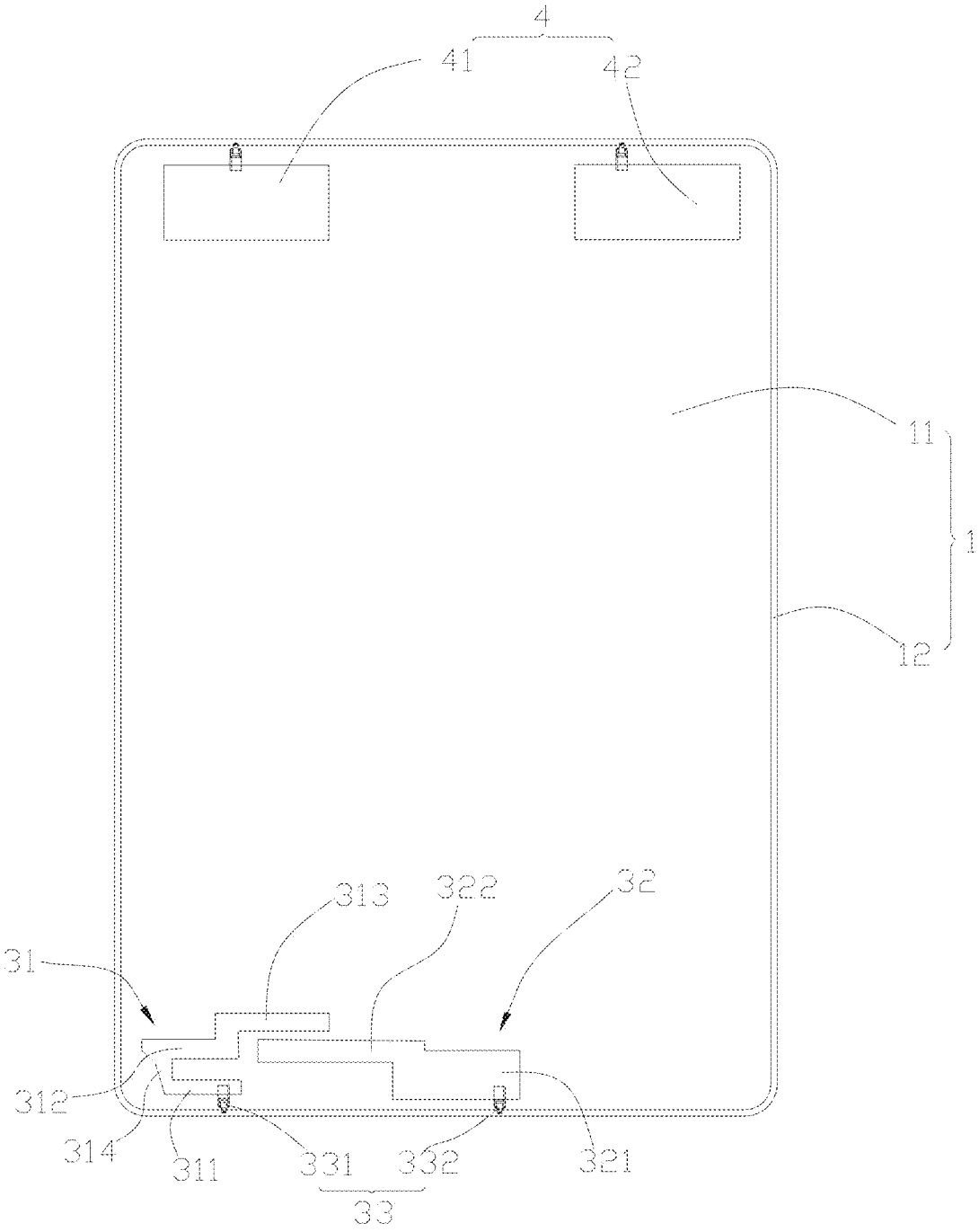
FIG. 2 is an illustrative structure of the antenna system of the mobile terminal in FIG. 1.

With reference to FIG. 1 and FIG. 2, a mobile terminal 100 in accordance with an exemplary embodiment of the present disclosure comprises a housing 1, a mainboard 2 and a main antenna 3.

The housing 1 further comprises a housing 11 and an end-to-end closed metal frame 12 which together forms an accommodation space. The mainboard 2 is provided with a ground point through which an antenna system is grounded, and the metal frame 12 serves as the radiator of the antenna system.

Furthermore, the mobile terminal 100 is also provided with a subsidiary antenna system 4 which comprises a decomposing antenna 41 and a functional antenna 42. The functional antenna 42 is also connected with the mainboard 2 and grounded through the mainboard 2, similarly, the functional antenna 42 also feeds power to the metal frame 12 and radiates through the same. The functional antenna may be a WIFI antenna or a GPS antenna.

The main antenna 3 is separated from the subsidiary antenna system 4 through a matching system 30. The matching system 30 may be a device with power supply which may be a tuner or converter, or a device without power supply which may be a lumped element. Matching systems are added to the different locations of the metal frame 12. The specific locations and spacing of the matching systems may affect the length of the effective radiators of the antenna and then affect the transmitting/receiving frequency of the antennae, so the number, locations and spacing of specific matching systems are determined as appropriate.

The main antenna 3 comprises a low-frequency feeding portion 31 and a high-frequency feeding portion 32, wherein the low-frequency feeding portion 31 is separated from the high-frequency feeding portion 32 through an LC filtering and separation system. In the present invention, the antenna is a printed antenna printed on an antenna bracket. As show in FIG. 3, a structural diagram of the antenna and the antenna bracket according to the present invention, the low-frequency feeding portion 31 comprises a first extending part 311, a second extension part 312 provided in the same direction with the first extending part 311 but spaced from the first extending part 311, and a third extension part 313 bend-extending from the end of the second extension part 312, wherein the third extension part 313 is L-shaped and the end thereof away from the second extension part 312 extends in the same direction with the first extending part 311. A connecting part 314 is provided between the first extending part 311 and the second extension part 312. The connecting part 314 is provided at the end away from the third extension part 313 and may be an arc, a strip or an irregular geometric figure. The shape may be adapted to the operating frequency of the antenna, and it is an irregular figure in the embodiment. The end of the connecting part near the second extension part 312 is wider than the end near the first extending part 311. The high-frequency feeding portion 32 comprises a main body 321 and a fourth extension part 322 extending from the main body 321 toward the direction of the low-frequency feeding portion 31. The fourth extension part 322 is provided opposite to the third extension part 313 of the low-frequency feeding portion 31 with interval, and the spacing is adapted to the frequency. Preferably, the fourth extension part 322 is provided parallel to the third extension part 313.

The main antenna 3 further comprises a feeding end 33 intended for connecting the main antenna 3 to the metal frame 12 in such a way that the metal frame 12 serves as the radiator of the antenna system to receive and transmit electromagnetic radiation. The feeding end 33 further comprises a low-frequency feeding end 331 and a high-frequency feeding end 332, wherein the low-frequency feeding end 331 is provided on the first extending part 311 of the low-frequency feeding portion and the high-frequency feeding end 332 is provided on the main body 321 of the high-frequency feeding portion 32. The antenna system is double-fed to the common metal frame in such a way to generate high and low frequencies and produce antenna multiplexing effects, thus it removes the need of making a slot in the back cover of the mobile terminal and makes products more attractive.

Figure 3:
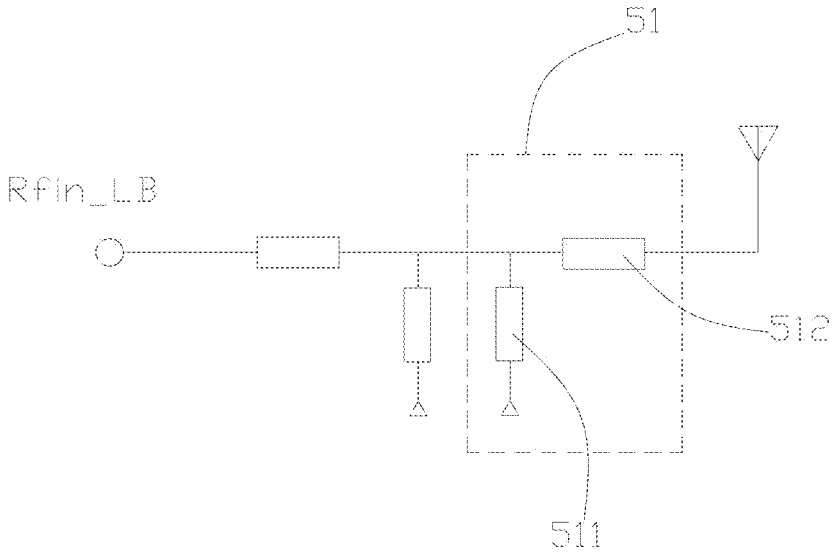
FIG. 3 is an equivalent-circuit diagram of a high-frequency feeding portion of a main antenna of the antenna system.
Figure 4:
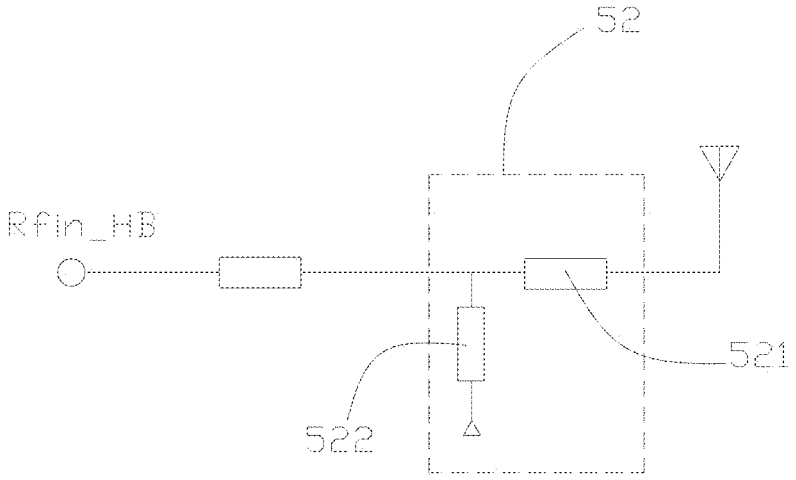
FIG. 4 is an equivalent-circuit diagram of a low-frequency feeding portion of the main antenna of the antenna system.

As show in FIGS. 3 and 4, an equivalent circuit diagram of the main antenna 3, both the low-frequency feeding portion 31 and the high-frequency feeding portion 32 have a respective LC separating system, wherein the low-frequency feeding portion 31 is equivalent to a LC circuit and a low-frequency isolating system 51 connected with the LC circuit, while the high-frequency feeding portion 32 is equivalent to a capacitor and a high-frequency isolating system 52 connected in serial with the capacitor. The isolating system may specifically be equivalent to a parallel circuit comprising a capacitor and an inductor, wherein the values of the capacitor and the inductor are dependent on the frequency. In the embodiment, the low-frequency isolating system 51 is equivalent to a 2.4 pF capacitor 511 and a 15 nH inductor 512, and the inductor 512 is connected to the feeding end of the antenna, while the high-frequency isolating system 52 is equivalent to a 0.5 pF capacitor 521 and a 5.1 nH inductor, and the inductor 521 is connected to the feeding end of the antenna.

Furthermore, the main antenna 3 is located at the bottom of the accommodation space of the mobile terminal, while the functional antenna 42 is located at the top of the accommodation space. The mainboard 2 is used for bearing the antenna system and other functional devices of the mobile terminal, such as microphone and loudspeaker. A clearance zone is arranged around the main antenna where no other electronic components shall be provided, to prevent the electronic components from interfering antenna signals. The area of the clearance zone depends on the sizes of the mobile terminal and the antenna bracket, and the height of the clearance zone is at least greater than twice the height of the antenna bracket. Preferably, a clearance zone is also arranged around the functional antenna 42.

In the embodiment of the present invention, the main antenna 3 is an LTE antenna module with frequency band of 824 MHz-960 MHz or 1710 MHz-2690 MHz.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A mobile terminal, comprising:

a housing having an accommodation space, the housing including an end-to-end closed metal frame;

a mainboard received in the accommodation space and including a ground point provided on a surface thereof;

an antenna system;

the antenna system comprising:

a main antenna including a low-frequency feeding portion and a high-frequency feeding portion both of which are respectively connected to the metal frame;

a matching system configured on the metal frame for adjusting the frequency band of the antenna system; wherein the high-frequency feeding portion is isolated from the low-frequency feeding portion through a LC filtering system;

the mainboard is provided with a ground point through which the antenna system is grounded, and the metal frame serves as the radiator of the antenna system.

2. The mobile terminal as described in claim 1 further comprising a functional antenna opposite to the main antenna, the functional antenna feed power to the metal frame and radiate through the metal frame.

3. The mobile terminal as described in claim 2, wherein the main antenna and the functional antenna are separated from each other through the matching system.

4. The mobile terminal as described in claim 3, wherein the matching system is a device without power supply.

5. The mobile terminal as described in claim 3, wherein the matching system is a device with power supply.

6. The mobile terminal as described in claim 3, wherein the matching system is at least one of a lumped element, a tuner and a converter.

7. The mobile terminal as described in claim 2, wherein the functional antenna is a WIFI antenna or a GPS antenna.

8. The mobile terminal as described in claim 1, wherein a clearing zone is arranged around the antenna system.

9. The mobile terminal as described in claim 1, wherein the low-frequency feeding portion comprises a first extending part, a second extension part extending parallel to but spaced from the first extending part, and a third extension part bend-extending from an end of the second extension part, the third extension part is separated from the first extending part, further, a connecting part is provided between the first extending part and the second extension part for connecting the first extending part and the second extension part.

10. The mobile terminal as described in claim 9, wherein the high-frequency feeding portion comprises a main body portion and a fourth extension part extending from the main body portion toward the low-frequency feeding portion, the fourth extension part is configured to be opposite to the third extension part of the low-frequency feeding portion, the fourth extension part is separated from the third extension part.

* * * * *